United States Patent [19]

Everman et al.

[11] Patent Number: 4,698,951

[45] Date of Patent: Oct. 13, 1987

[54] APPARATUS AND METHOD FOR FORMING, INSERTING, FILLING AND CLOSING A CONTAINER LINER BAG

[75] Inventors: Wayne F. Everman, Cedar Falls; Randy J. Klug, Dike, both of Iowa

[73] Assignee: Container Corporation of America, Alton, Ill.

[21] Appl. No.: 419

[22] Filed: Jan. 5, 1987

[51] Int. Cl.[4] ..... B65B 9/13; B65B 9/14; B65B 43/00; B65B 43/04

[52] U.S. Cl. ..... 53/449; 53/459; 53/175; 53/567

[58] Field of Search ..... 53/449, 459, 469, 175, 53/567, 452, 558, 576

[56] References Cited

U.S. PATENT DOCUMENTS

| | | | |
|---|---|---|---|
| 2,532,871 | 12/1950 | Wagner | 53/175 X |
| 3,523,492 | 8/1970 | Bruce et al. | 53/175 X |
| 3,762,023 | 10/1973 | Bruce | 53/175 X |
| 3,774,509 | 11/1973 | Heinzer | 53/175 X |
| 3,824,760 | 7/1974 | Sinichenko et al. | 53/567 X |
| 4,052,931 | 10/1977 | Morse et al. | 53/175 X |
| 4,089,255 | 5/1978 | Akoh et al. | 53/175 X |
| 4,244,159 | 1/1981 | Gess | 53/567 |
| 4,338,761 | 7/1982 | Gess | 53/567 X |

*Primary Examiner*—Horace M. Culver
*Attorney, Agent, or Firm*—Richard W. Carpenter

[57] ABSTRACT

Apparatus and method wherein at a single operating station a flexible liner bag can be formed and inserted into an outer bulk container, and then the bag can be filled and its open end closed and sealed automatically.

6 Claims, 10 Drawing Figures

APPARATUS AND METHOD FOR FORMING, INSERTING, FILLING AND CLOSING A CONTAINER LINER BAG

BACKGROUND OF THE INVENTION

1. Field of the Invention:

This invention relates generally to bulk shipping containers, and more particularly to a composite container which includes a heavy duty corrugated paperboard outer box having an inner liner bag formed of flexible material such as film. The invention provides an improved method and apparatus for forming, inserting, filling, and closing a liner bag for a shipping container.

2. Description of the Prior Art:

A prior art search directed to the subject matter of this application in the U.S. Patent and Trademark Office disclosed the following U.S. Pat. Nos.: 1,609,491; 2,216,586; 2,258,013; 2,328,796; 3,523,492; 3,710,693; 3,897,674; 3,978,773; 4,089,255; 4,083,293; 4,430,068.

None of the prior art patents uncovered in the search discloses a method and apparatus, located entirely at a single operating station, for forming a flexible liner bag, inserting it into a bulk shipping container, and filling and closing the bag in the matter of the present invention.

SUMMARY OF THE INVENTION

It is an object of the invention to provide an improved apparatus and method whereby, at a single operating station, a flexible liner bag can be formed and inserted into a bulk shipping container and then filled and closed.

A more specific object of the invention is the provision of a novel filling arrangement for a lined container, wherein the end of a flexible liner bag for an outer shipping container can be cuffed over the upper end of an inverted funnel shaped filling duct, while the bag is filled from a movable filling spout, so that the bag can thereafter be clamped and closed by automatic closing means located at the upper end of the container.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

The present invention represents an improvement over the invention disclosed in U.S. Pat. No. 4,537,584.

In the earlier patent the concept was to cuff the open end of a liner bag over an outer shipping container prior to filling the bag.

One disadvantage with this arrangement was the difficulty in grasping the open end of the bag and closing and sealing it once it had been cuffed over the upper end of a shipping container.

The present invention contemplates a means for retaining control of the open end of the bag, so that after the liner bag has been filled, its open end can be closed and sealed automatically.

As mentioned earlier in the specification, it is an object of the invention to provide a method and apparatus whereby, at a single station, a flexible liner bag can be formed, inserted into an outer bulk shipping container, filled, and then closed and sealed.

Figure 1:
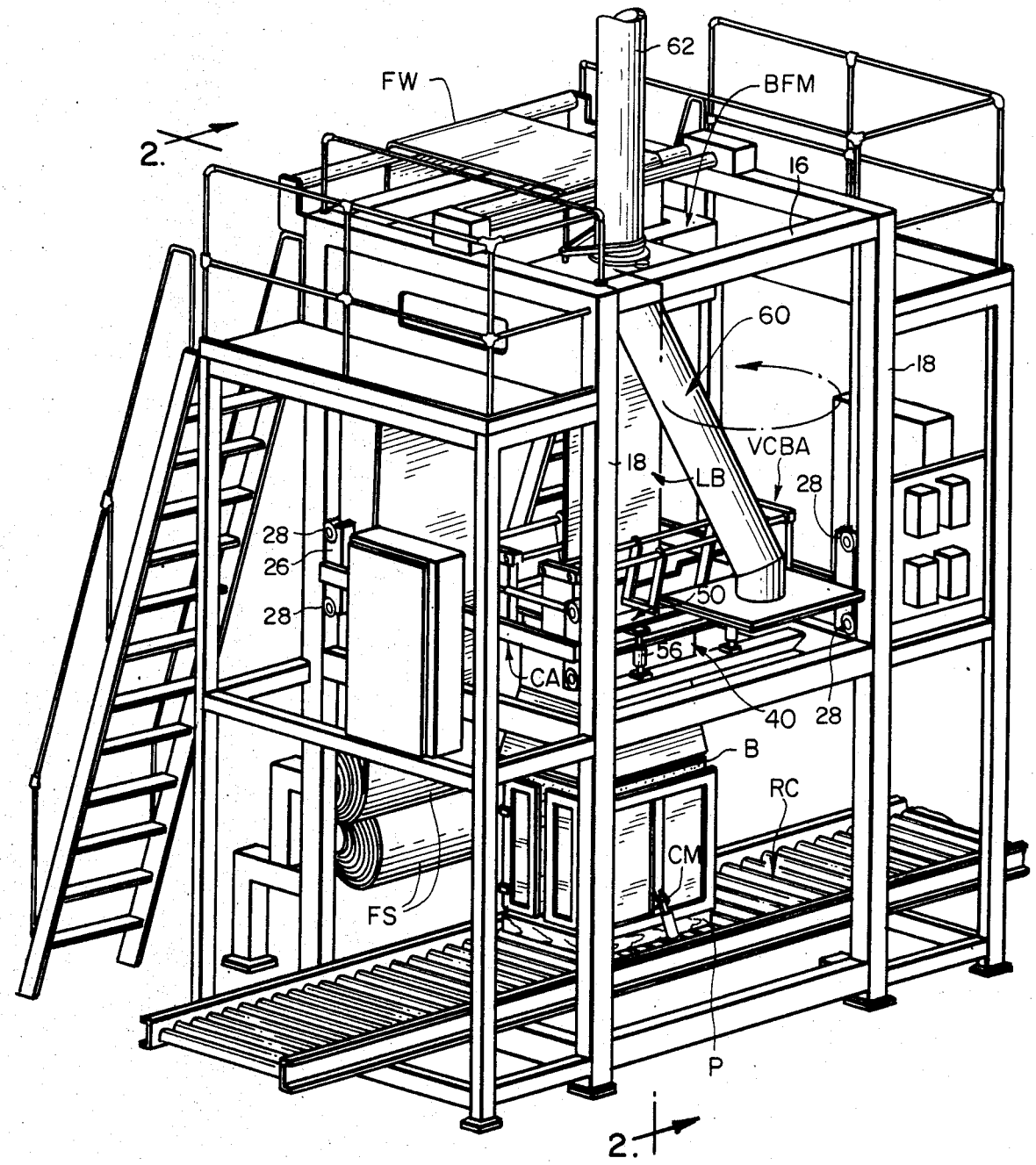
FIG. 1 is a fragmentary perspective view of apparatus, embodying features of the present invention, for forming, inserting, filling and closing a container liner bag.

A perspective view of the apparatus is illustrated in FIG. 1. the apparatus includes a frame structure, indicated generally at 10, having a plurality of: lower horizontal members or beams 12, intermediate horizontal members or beams 14, and upper horizontal members or beams 16. The beams are interconnected by a plurality of vertical members or columns 18.

Figure 2:
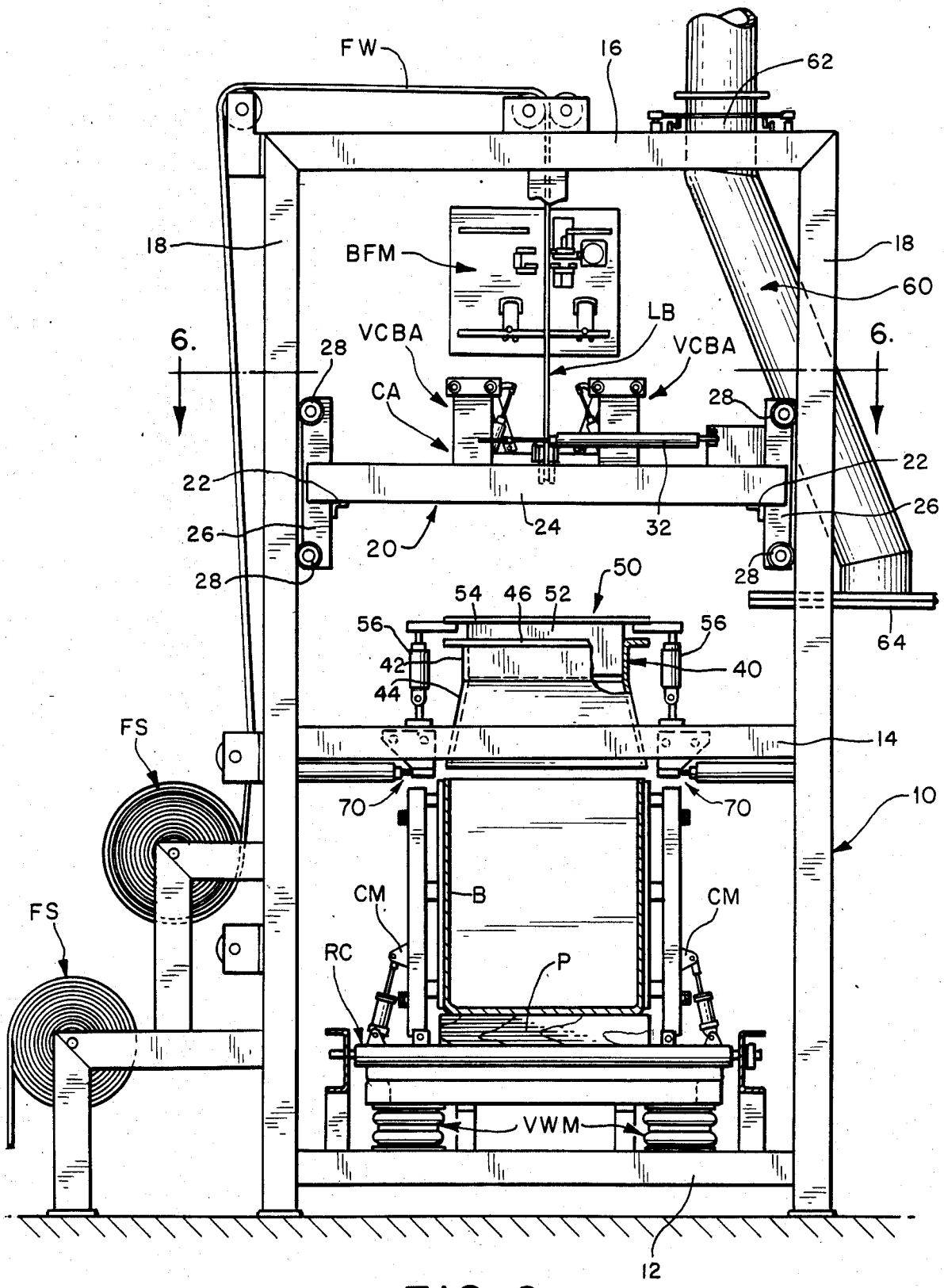
FIGS. 2–5 are side elevational views of the structure illustrated in FIG. 1 showing successive stages of the bag forming, inserting, filling, and closing operations.

Referring to FIGS. 1 and 2, it will be seen that there is supported on the lower horizontal members 12 of the frame structure a horizontally disposed roller conveyor, indicated generally at RC. The details of the conveyor are not illustrated, because the conveyor may be of a conventional type.

Positioned under the roller conveyor RC, but still supported by the lower horizontal members 12 of the frame structure, is a mechanism for vibrating and weighing the container and its contents. This mechanism is indicated generally at VWM, but is not shown in great detail, because the mechanism is not essential to the invention of this particular patent application and is in fact the subject of another patent application.

As best seen in FIG. 2, there is positioned on the roller conveyor RC a relatively large, heavy duty, corrugated bulk shipping container indicated generally at B which is positioned on a pallet P.

As can be seen in FIGS. 1, 2 and in other views, there is carried by the frame structure 10 a clamping mechanism, indicated at CM, the purpose of which is to maintain the walls of the container in a straight or non-bulging condition when it is filled. Again, the details of the clamping mechanism CM are not shown, as this also forms a part of anther patent application, and its structural details are not essential to the present invention.

Figure 3:
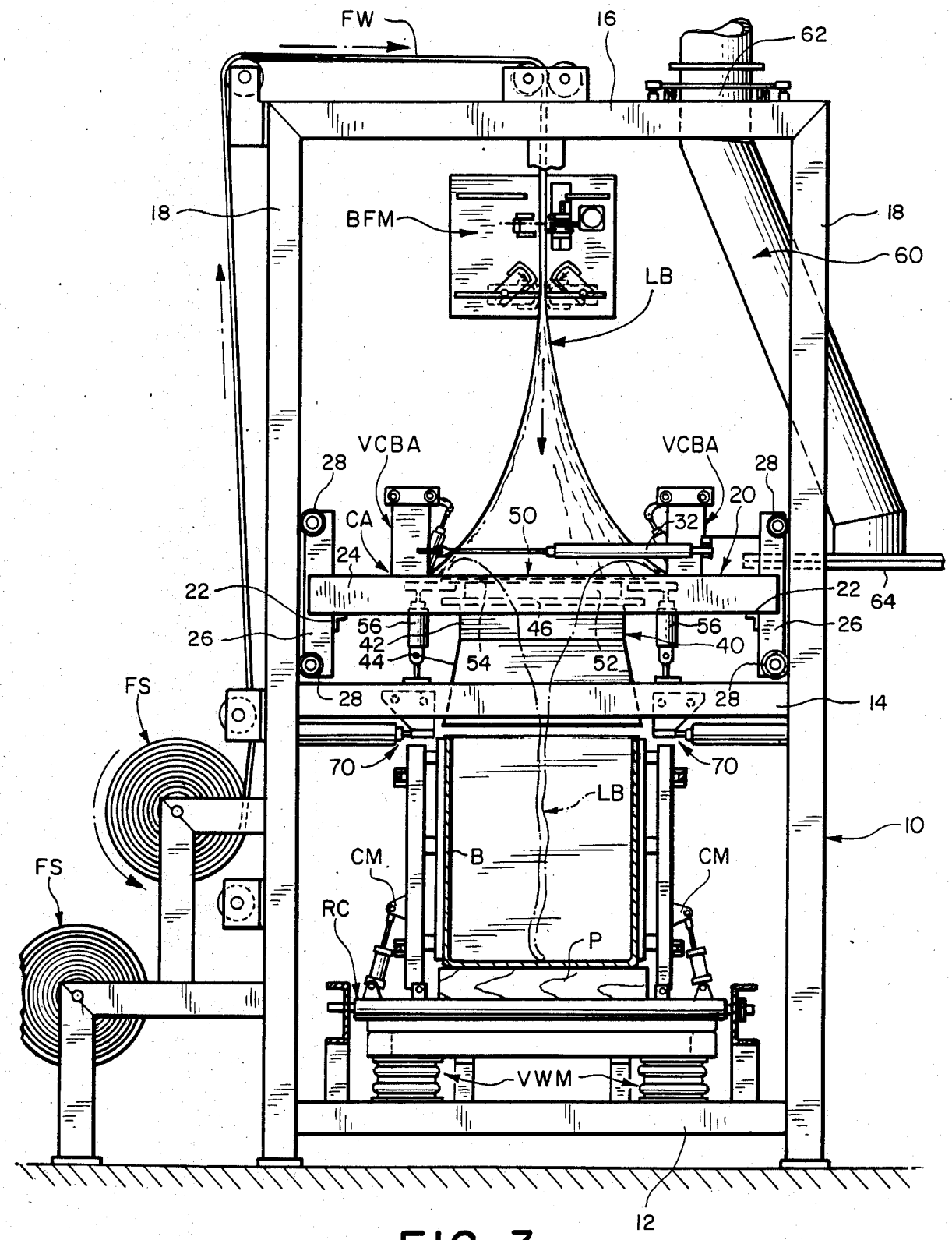
Figure 4:
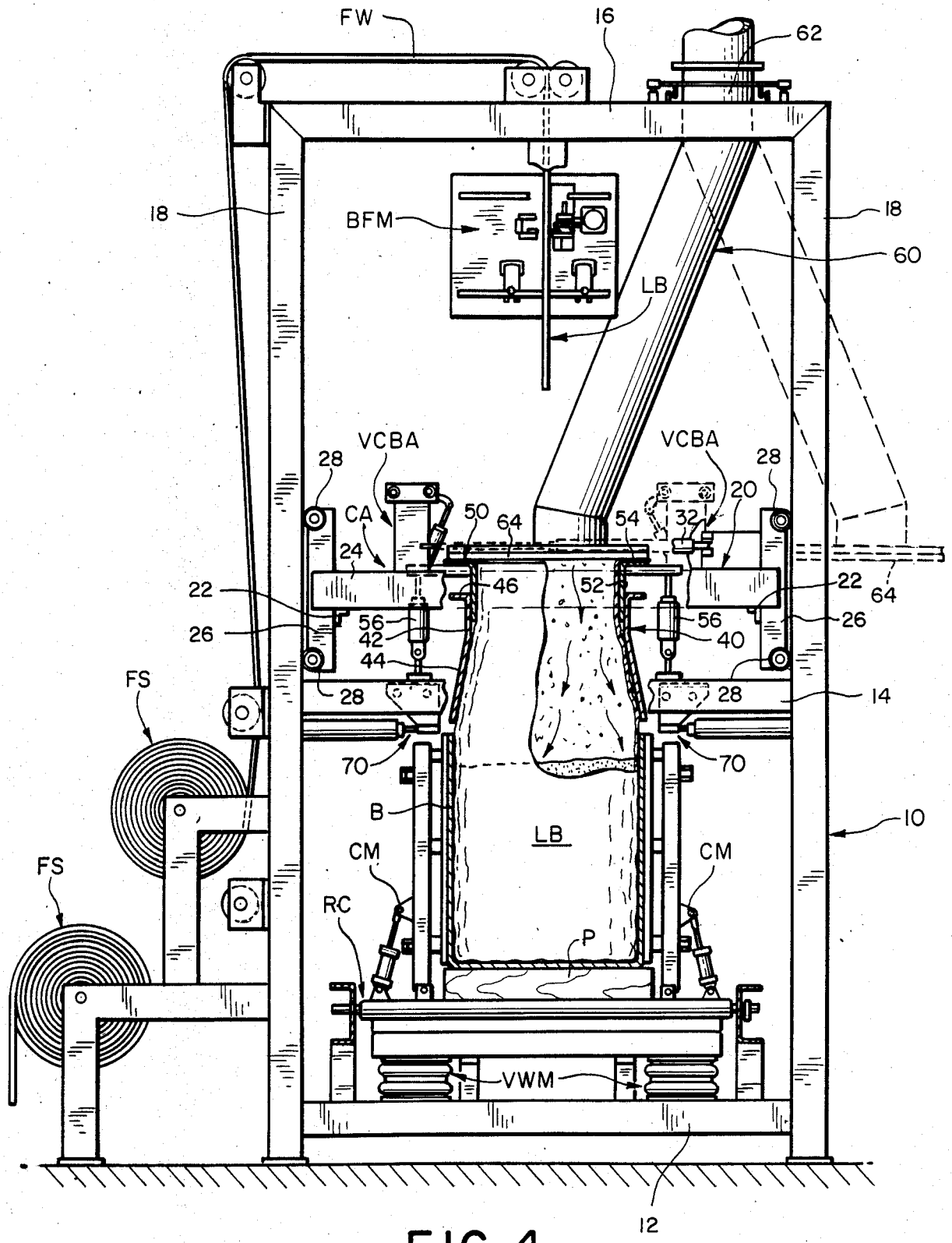

As seen in FIGS. 2–4, there is carried by the frame, in an upper area thereof, a liner bag forming mechanism indicated generally at BFM. Again, the details of this mechanism are not shown to any great extent, because they are very similar to the mechanism shown, described, and claimed in detail in U.S. Pat. No. 4,537,584.

The bag forming mechanism BFM is utilized to form liner bags, indicated generally at LB, from a web of tubular flexible film, indicated at FW, which is dispensed from one or more spools or reels FS of film mounted on a lower portion of the frame structure 10.

In order to transfer the completed liner bag LB from the bag forming mechanism BFM there is provided a carriage assembly CA which is mounted for vertical movement on the frame structure 10.

The carriage assembly CA is similar to the carriage assembly described and illustrated in previously mentioned U.S. Pat. No. 4,537,584. The carriage assembly includes a frame 20 having a pair of horizontal front and rear end members 22 and a pair of horizontal side members 24 connected to each other and also connected at the corners to vertical members 26 which carry rollers 28 adapted to ride in tracks of the vertical members 18 of frame structure 10.

The carriage assembly CA includes a pair of vacuum carrier bar assemblies, indicated generally at VCBA, which are disposed for lateral movement toward and away from each other to grasp the free end of a liner bag and spread it open, so that it can be cuffed over the filling equipment.

The vacuum carrier bar assemblies VCBA are similar to those disclosed in the previously mentioned U.S. Pat. No. 4,537,584. Each assembly includes a transverse bar 30. The bars can be moved toward and away from each other by means of a mechanism which includes at least one power cylinder 32. Each of the bars carry vacuum cup means 34 for grasping the sides of the liner bag, as described later in the specification, and fingers 36, for engaging the bag and spreading it open, so that it can be cuffed over a filling duct as described later in the specification.

The essential feature of the present invention covered by this application resides in the unique means for holding the bag, filling the bag, and closing the bag automatically.

As best seen in FIG. 2, a tubular filling duct indicated generally at 40, is mounted on the frame directly above a bulk container B which has been positioned at the work station. Filling duct 40 is generally rectangular in cross-section and includes a fixed portion having vertically disposed upper side walls 42 and downwardly and outwardly flared lower side walls 44. Upper side walls 42 have, at the upper edge thereof, an outwardly projecting horizontal flange 46.

Filling duct 40 also includes a movable sleeve portion indicated generally at 50, is mounted for limited vertical telescoping movement within the fixed upper portion of filling duct 40. Sleeve 50 includes a tubular body 52 having at its upper end an outwardly projecting horizontal flange 54.

Limited vertical movement of sleeve 50 may be accomplished by an actuating mechanism which includes one or more operating cylinders 56.

The liner bag is filled through the filling duct 40 and also through a vertical, laterally movable filling spout, indicated generally at 60. The upper portion 62 of the filling spout is mounted on an upper horizontal member 16 of frame structure 10, and the lower end of the filling spout includes a peripheral, horizontal flange 64 adapted to engage flange 54 on the movable sleeve, as described later in the specification.

Figure 5:
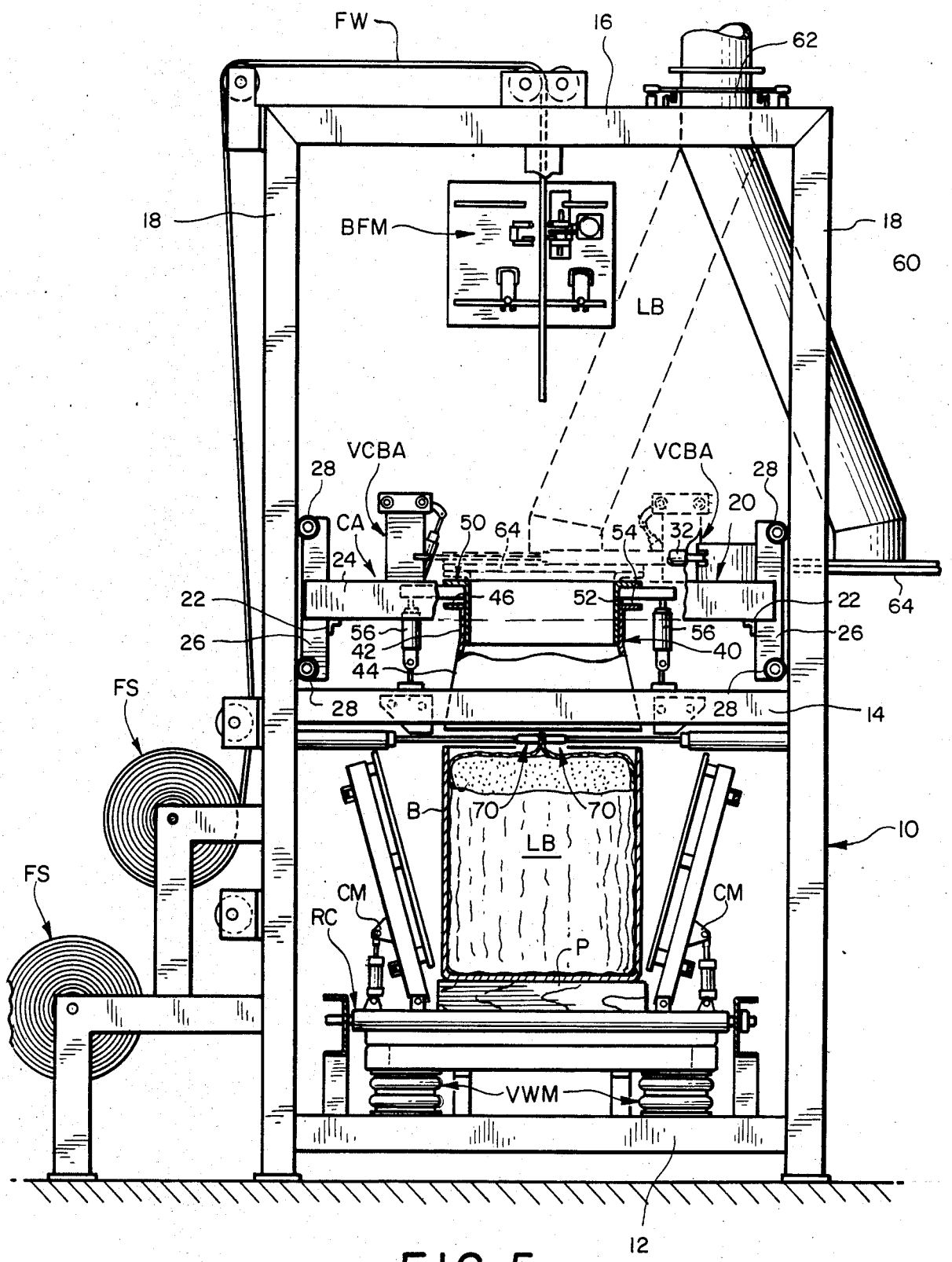
Figure 6:
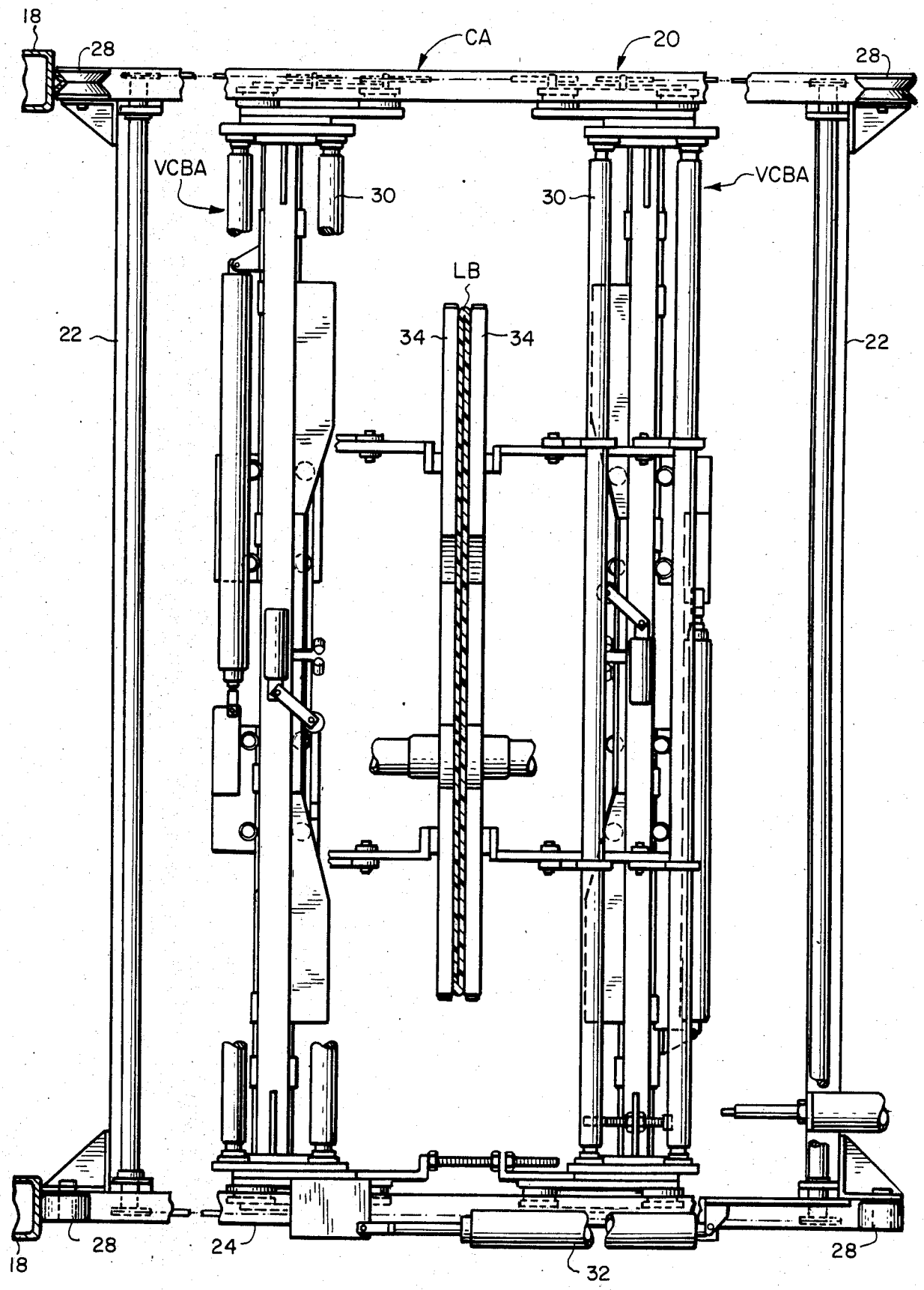
FIG. 6 is a fragmentary top plan view taken along line 6—6 of FIG. 2.
Figure 7:
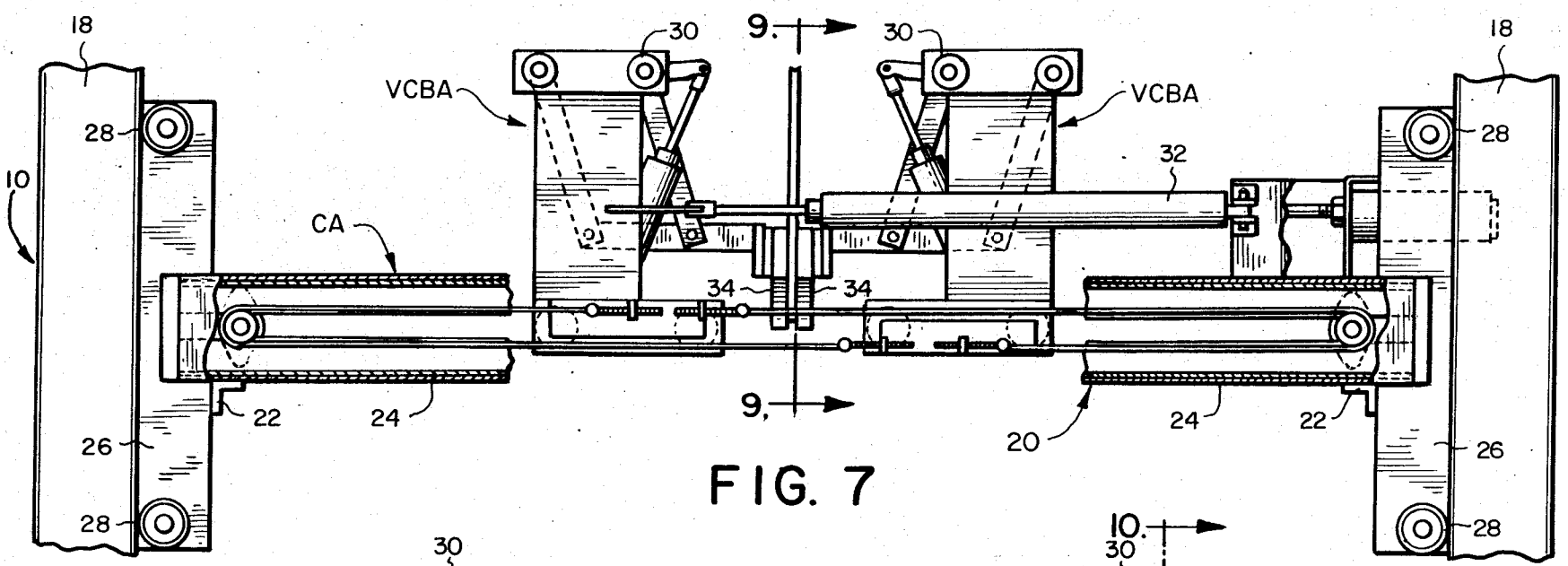
FIGS. 7 and 8 are side elevational views of the carriage assembly illustrated in other views, but showing the vacuum carrier bar assemblies in different postions.
Figure 8:
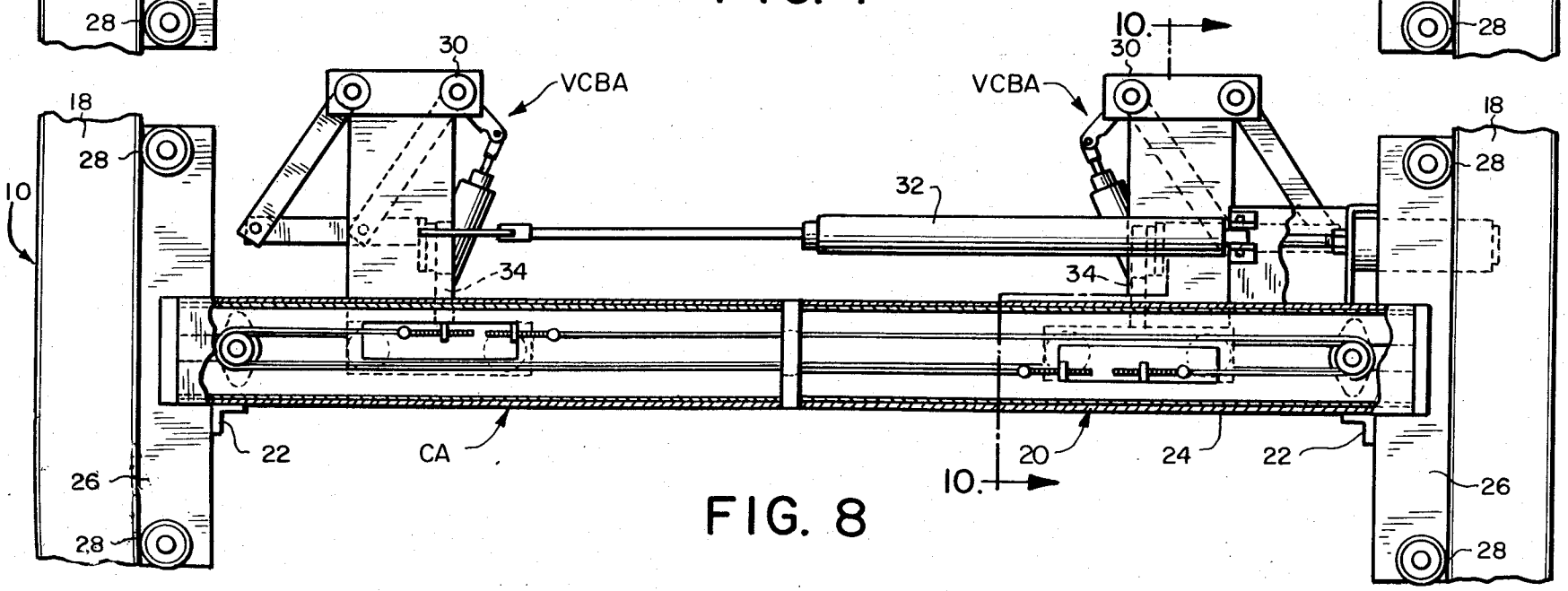
Figure 9:
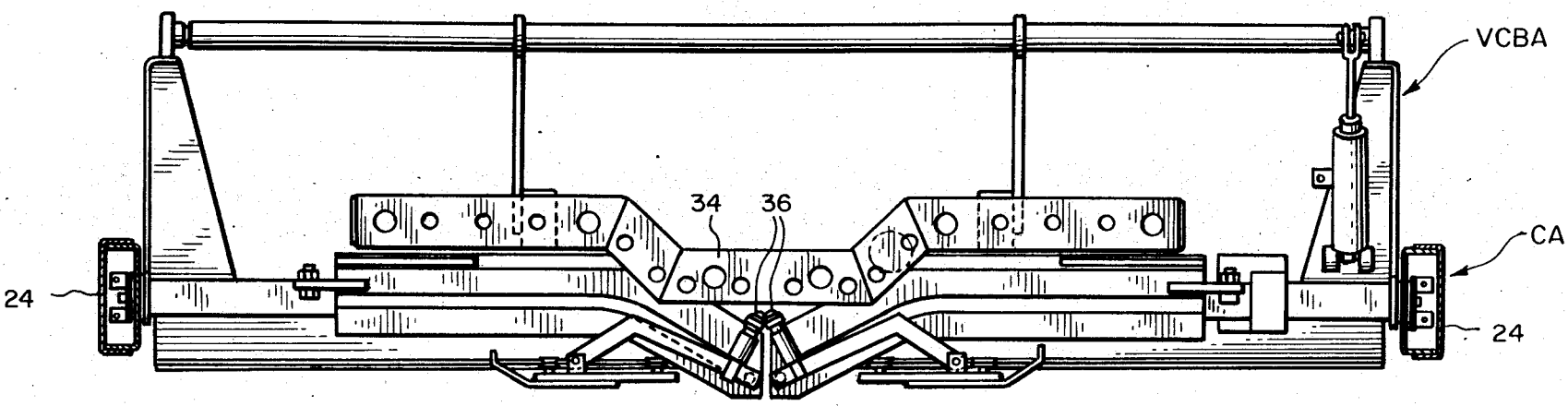
FIG. 9 is a fragmentary transverse vertical sectional view taken on line 9—9 of FIG. 7.
Figure 10:
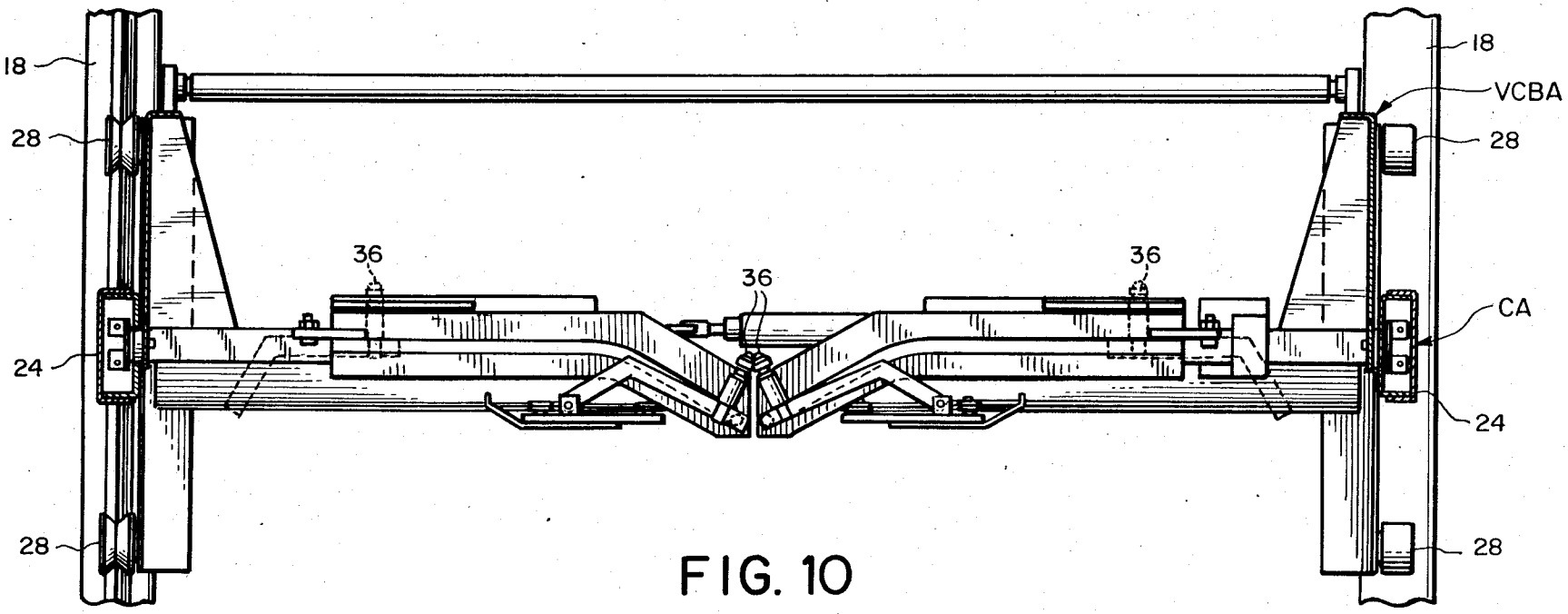
FIG. 10 is a fragmentary transverse sectional view taken on line 10—10 of FIG. 7.

Filling spout 60 is positioned for limited lateral movement, so that it can be moved, from the non-filling position illustrated in FIGS. 2 and 3 to the filling position illustrated in FIGS. 4 and 5, in a manner hereinafter described.

Now to describe the operation of the apparatus and the method whereby a liner bag is formed from flexible sheet material, inserted into a shipping container, filled, and closed.

An outer bulk shipping container B, positioned on a pallet P is conveyed by the roller conveyor RC to the work station within frame structure 10.

After the container is in position, a plastic liner bag LB is formed by the bag forming mechanism BFM at the top of the frame structure 10. The bag is formed in an inverted position with its free open end facing downwardly.

The vacuum carrier bar assemblies VCBA of the carriage assembly CA then engage the outer surfaces of the bag and pull it downwardly toward sleeve 50. At the same time the fingers 36 on the transverse bars 30 engage the inside of the open end of the bag to spread the bag outwardly over the edge of the flange 54 on movable sleeve 50 which is telescopingly received within the fixed portion of filling duct 40.

When the bag end has been cuffed over sleeve 50, the lower end of the filling spout 60 is rotated into position where it is in vertical alignment with the movable sleeve 50 and filling duct 40.

The movable sleeve 50 is then moved upwardly a slight distance, by the actuating mechanism 56, so that the free open end of the liner bag LB is trapped and clamped between the upper surface of movable sleeve flange 54 and the lower surface of filling spout flange 64.

At this time air may be introduced through the filling spout 60 into the liner bag to insure that the bag is completely open and disposed against the inside surfaces of container B. The bag is then filled through filling spout 60.

After the bag has been filled, the filling spout is moved out of the way, so that the carriage assembly CA can move back upwardly to grasp another bag and repeat the cycle. At the same time the neck of the bag is engaged by a clamping and sealing mechanism, indicated generally at 70 and best seen in FIG. 5. The details of mechanism 70 are not shown to any great extent, because it may be a conventional unit including heat sealing type jaws that grip and seal the bag.

After this has been accomplished, the gripping and sealing jaws move out of the way, and the container B and pallet P are moved along the roller conveyor RC to another station where a lid or cover may be applied to the container. This makes room for a new empty container to be moved into the work station so the cycle can be repeated.

Thus, it will be appreciated that the invention provides an efficient method and also equipment whereby a flexible liner bag can be automatically formed, inserted into a container, filled, closed, and sealed all at the same work station.

What is claimed is:

1. Apparatus located entirely at a single work station for automatically forming a flexible liner bag, inserting it into a bulk shipping container, and filling and closing said bag, said apparatus comprising:

(a) a frame structure;

(b) a platform carried by said frame structure adjacent the lower end thereof for supporting a bulk shipping container;

(c) bag forming means carried by said frame structure adjacent the upper end thereof for forming, from tubular stock of flexible sheet material, a liner bag in an inverted position with its open end disposed below its closed end;

(d) a vertically extending filling duct positioned below said bag forming means and above a container on said platform;

(e) bag clamping means for grasping said liner bag at its open end and cuffing it over an open upper end of said filling duct as the closed end of said liner bag is dropped through said duct into said container;

(f) a filling spout positioned above said filling duct and mounted for movement into and out of alignment with the open upper end of said filling duct;

(g) bag closing and sealing means mounted below said filling duct for closing and sealing the open end of said liner bag after it has been filled.

2. Apparatus located entirely at a single work station for automatically inserting a flexible liner bag into a bulk shipping container, and filling and closing said bag, said apparatus comprising:

(a) a frame structure;

(b) a conveyor for supporting a bulk shipping container under said frame structure;

(c) a vertically extending filling duct supported by said frame structure above a container on said conveyor;

(d) bag clamping means for grasping a liner bag, in an inverted position, at its open end and cuffing it over an open upper end of said filling duct as the closed end of said liner bag is dropped through said duct into said container;

(e) a filling spout positioned above said filling duct and mounted for movement into and out of alignment with the open upper end of said filling duct;

(f) bag closing and sealing means mounted below said filling duct for closing and sealing the open end of said liner bag after it has been filled.

3. A method for inserting a flexible liner bag into a bulk shipping container, filling the bag, and closing and sealing it at a single work station, comprising the steps of:

(a) positioning a container under a tubular filling duct;

(b) grasping the open end of a liner bag that is in an inverted position, cuffing the open end of the bag over an upper end of said filling duct and dropping the closed end of the bag into the container;

(c) moving a lower end of a filling spout over an upper end of said filling duct and clamping said liner bag open end between opposing flanges of said filling duct and said filling spout;

(d) filling said bag through said filling spout and filling duct;

(e) clamping and sealing the open end of said bag at a location below said filling duct;

(f) releasing said bag end from between said filling spout and filling duct flanges.

4. Apparatus according to claim 2, wherein said filling duct and filling spout have complementary flanges adapted to clamp an end portion of a liner bag therebetween.

5. Apparatus according to claim 2, wherein said filling duct includes a fixed lower portion and a movable upper portion telescoped within said fixed lower portion.

6. Apparatus according to claim 5, wherein said filling duct movable upper portion has a peripheral flange adapted to cooperate with a similar flange on a lower end of said filling spout to clamp a free end portion of said liner bag therebetween.

* * * * *